US008960134B1

(12) United States Patent
Zahdeh et al.

(10) Patent No.: US 8,960,134 B1
(45) Date of Patent: Feb. 24, 2015

(54) TARGETED COOLING WITH INDIVIDUALIZED FEEDING PORTS TO CYLINDERS

(71) Applicant: GM Global Technology Operations LLC, Detroit, MI (US)

(72) Inventors: Akram R. Zahdeh, Rochester Hills, MI (US); Dan L. Alden, Howell, MI (US); Colin Blacklock Bosman, Rochester Hills, MI (US); Robert S. McAlpine, Lake Orion, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/955,770

(22) Filed: Jul. 31, 2013

(51) Int. Cl.
*F02B 75/18* (2006.01)
*F01P 3/02* (2006.01)

(52) U.S. Cl.
CPC ..... *F01P 3/02* (2013.01)
USPC ..... 123/41.28; 123/41.82 R; 123/41.52

(58) Field of Classification Search
CPC ..... F01P 2003/027; F01P 2003/028; F01P 3/06; F02B 75/20
USPC ..... 123/41.28, 41.01, 41.52, 41.82 R, 41.81, 123/41.74, 41.72
See application file for complete search history.

(56) References Cited

U.S. PATENT DOCUMENTS

| | | | | |
|---|---|---|---|---|
| 2,152,594 | A * | 3/1939 | Klotsch | 123/41.28 |
| 4,109,617 | A * | 8/1978 | Ernest | 123/41.74 |
| 4,381,736 | A * | 5/1983 | Hirayama | 123/41.1 |
| 4,413,596 | A * | 11/1983 | Hirayama | 123/41.1 |
| 4,590,894 | A * | 5/1986 | Ishida et al. | 123/41.74 |
| 5,746,161 | A * | 5/1998 | Boggs | 123/41.72 |
| 6,581,550 | B2 * | 6/2003 | Shinpo et al. | 123/41.74 |
| 6,810,838 | B1 * | 11/2004 | Hellman | 123/41.28 |
| 7,225,766 | B2 * | 6/2007 | Zahdeh | 123/41.79 |
| 7,234,422 | B2 * | 6/2007 | Schlautman et al. | 123/41.74 |
| 2003/0000487 | A1 * | 1/2003 | Schmitt | 123/41.72 |
| 2011/0120394 | A1 * | 5/2011 | Onozawa et al. | 123/41.1 |

* cited by examiner

*Primary Examiner* — Noah Kamen
*Assistant Examiner* — Long T Tran
(74) *Attorney, Agent, or Firm* — Harness, Dickey & Pierce, P.L.C.

(57) ABSTRACT

A cooling system for an engine having a plurality of piston cylinders. The cooling system can include a liquid coolant source having liquid coolant and a cylinder cooling passage network having an inlet and an outlet for receiving and transmitting the liquid coolant. The cylinder cooling passage network having a plurality of individual upstream fluidic passages each being fluidly coupled to the inlet to directly receive the liquid coolant from the liquid coolant source in parallel flow. The cylinder cooling passage network further having a plurality of cylinder jacket passages each extending about at least a portion of a corresponding one of the plurality of piston cylinders and being positioned immediately adjacent thereto. The cylinder jacket passages are fluidly coupled directly to a corresponding one of the plurality of individual upstream fluidic passages to receive the liquid coolant and transmit the liquid coolant to the outlet for improved cooling performance.

17 Claims, 6 Drawing Sheets

TARGETED COOLING WITH INDIVIDUALIZED FEEDING PORTS TO CYLINDERS

FIELD

The present disclosure relates to engine cooling systems and, more particularly, relates to an engine cooling system having individualized feeding ports for targeted cooling of engine cylinders.

BACKGROUND

This section provides background information related to the present disclosure which is not necessarily prior art.

Conventionally, internal-combustion engines comprise a plurality of cylinders. Each of the plurality of cylinders includes a cylindrical bore having a moveable piston disposed therein and an associated combustion source (e.g. spark plug) to ignite a chemical mixture (e.g. a combination of fuel and air) within the combustion chamber of the cylindrical bore as part of a two-cycle or four-cycle combustion process. The ignition of the chemical mixture by the combustion source results in the production of high-temperature, high-pressure gases that produce useable work (e.g. mechanical power) from the engine.

However, the resultant production of these high-temperature, high-pressure gases leads to the need to cool various portions of the internal-combustion engine. Modern engines, including internal-combustion engines and compression-ignition engines, manage engine operating temperatures using a cooling system. Typically, many modern cooling systems employ a liquid coolant that is particularly well-suited to extract heat from the engine to maintain a proper operating temperature of the various parts of the engine and transfer such heat to a radiator for dissipation. However, this cooling process can be difficult when used with many modern engines that are made of lightweight materials, such as aluminum. These lightweight materials are highly desired because of the associated weight reduction of the engine and, thus, the overall weight of the vehicle. By reducing the weight of the engine and the vehicle, improved fuel economy can be realized. However, lightweight materials used in the manufacture of modern engines have operating temperatures that are less than materials used in previous engines. Therefore, it is often important and/or desirable to carefully manage the operating temperature of these engines and their associated components using improved cooling systems and designs.

For example, in some engines employing four or more cylinders, the liquid coolant can be routed or otherwise pumped along at least a portion of the cylinders to extract heat from the cylinder block. Unfortunately, however, in conventional applications, this liquid coolant is typically introduced at one location, such as a first cylinder, and then travels along the remaining downstream cylinders to effect temperature reduction of the cylinders. As the liquid coolant is introduced and travels along the remaining cylinders, the temperature of the liquid coolant increases, thereby reducing the cooling effect of the liquid coolant on those downstream cylinders. Consequently, the downstream cylinders may not be cooled to the same temperature as the upstream cylinder(s). Accordingly, these downstream cylinders operate at different temperatures and may not remain in ideal operating conditions.

Accordingly, there exists a need in the relevant art to provide a cooling system that is capable of provide consistent cooling of the cylinders of an engine. Moreover, there exists a need in the relevant art to provide a cooling system capable of individually cooling each of a plurality of cylinders in the engines to a generally uniform temperature. Still further, there exists a need in the relevant art to provide a cooling system that provides individual feeding ports transferring liquid coolant directly to each of the cylinders to ensure generally uniform temperature of the cylinders.

SUMMARY

This section provides a general summary of the disclosure, and is not a comprehensive disclosure of its full scope or all of its features.

According to the principles of the present teachings, a cooling system for an engine having a plurality of piston cylinders is provided having advantageous construction and operation. The cooling system includes a liquid coolant source having liquid coolant and a cylinder cooling passage network having an inlet and an outlet for receiving and transmitting the liquid coolant. The cylinder cooling passage network having a plurality of individual upstream fluidic passages each being fluidly coupled to the inlet to directly receive the liquid coolant from the liquid coolant source in parallel flow. The cylinder cooling passage network further having a plurality of cylinder jacket passages each extending about at least a portion of a corresponding one of the plurality of piston cylinders and being positioned immediately adjacent thereto. The cylinder jacket passages are fluidly coupled directly to a corresponding one of the plurality of individual upstream fluidic passages to receive the liquid coolant and transmit the liquid coolant to the outlet for improved cooling performance.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
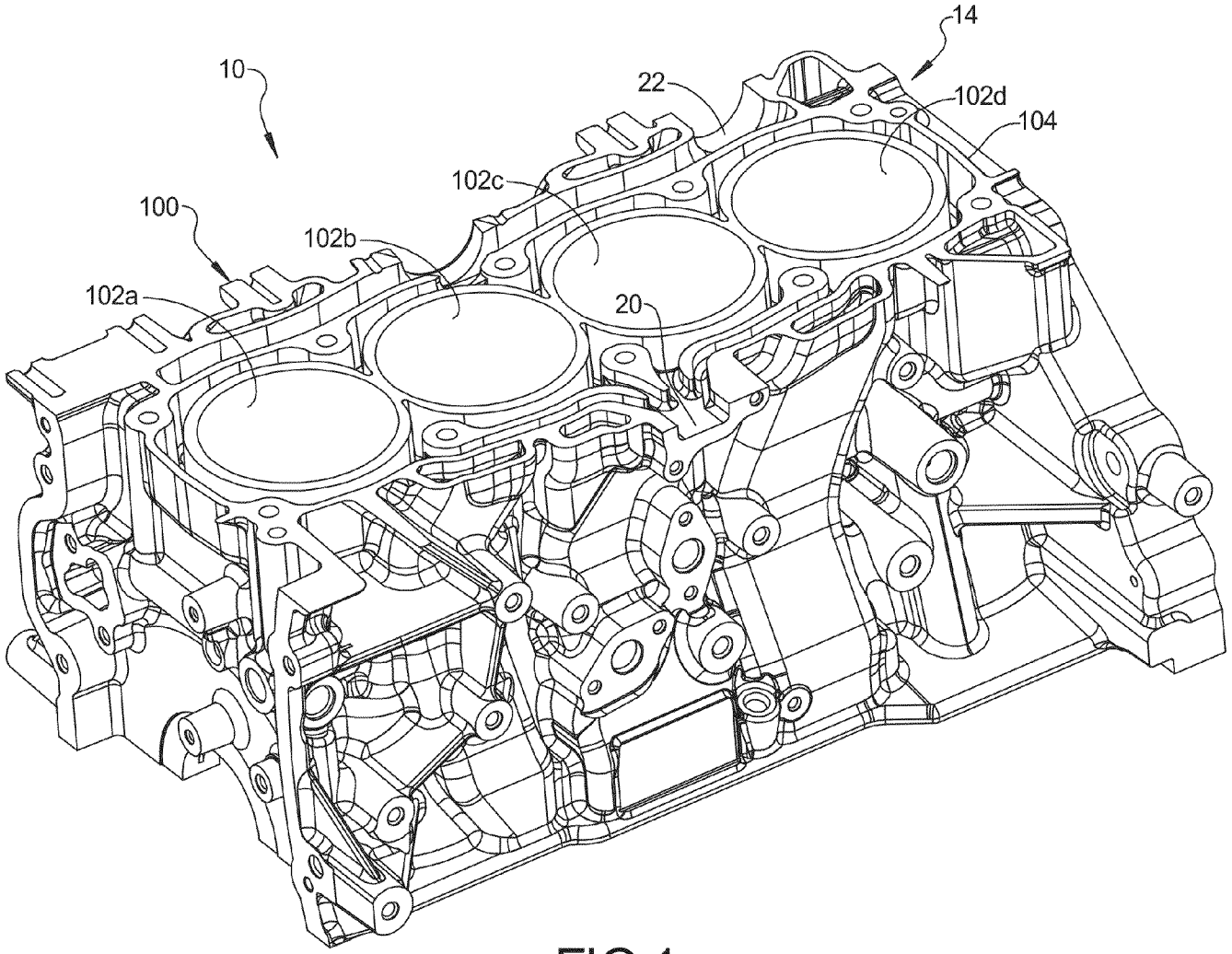
FIG. 1 is a perspective view of a cylinder block of an engine having a cooling system according to some embodiments of the present teachings.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-5, a cylinder block cooling system 10 is illustrated having advantageous construction and operation according to the principles of the present teachings. Cylinder block cooling system 10 is particularly well suited for use in an internal combustion engine 100 having a cylinder block 104. However, it should be understood that the present teachings will be disclosed in connection with an internal combustion engine, it should be recognized that the principles of the present teachings should not be regarded as being limited to such. The principles of the present teachings may be particularly advantageous in any engine application where heat is extracted from a plurality or series of engine cylinders using a liquid coolant. Therefore, although the present disclosure references internal combustion engines and processes, it should not be regarded as limiting the invention.

Figure 2:
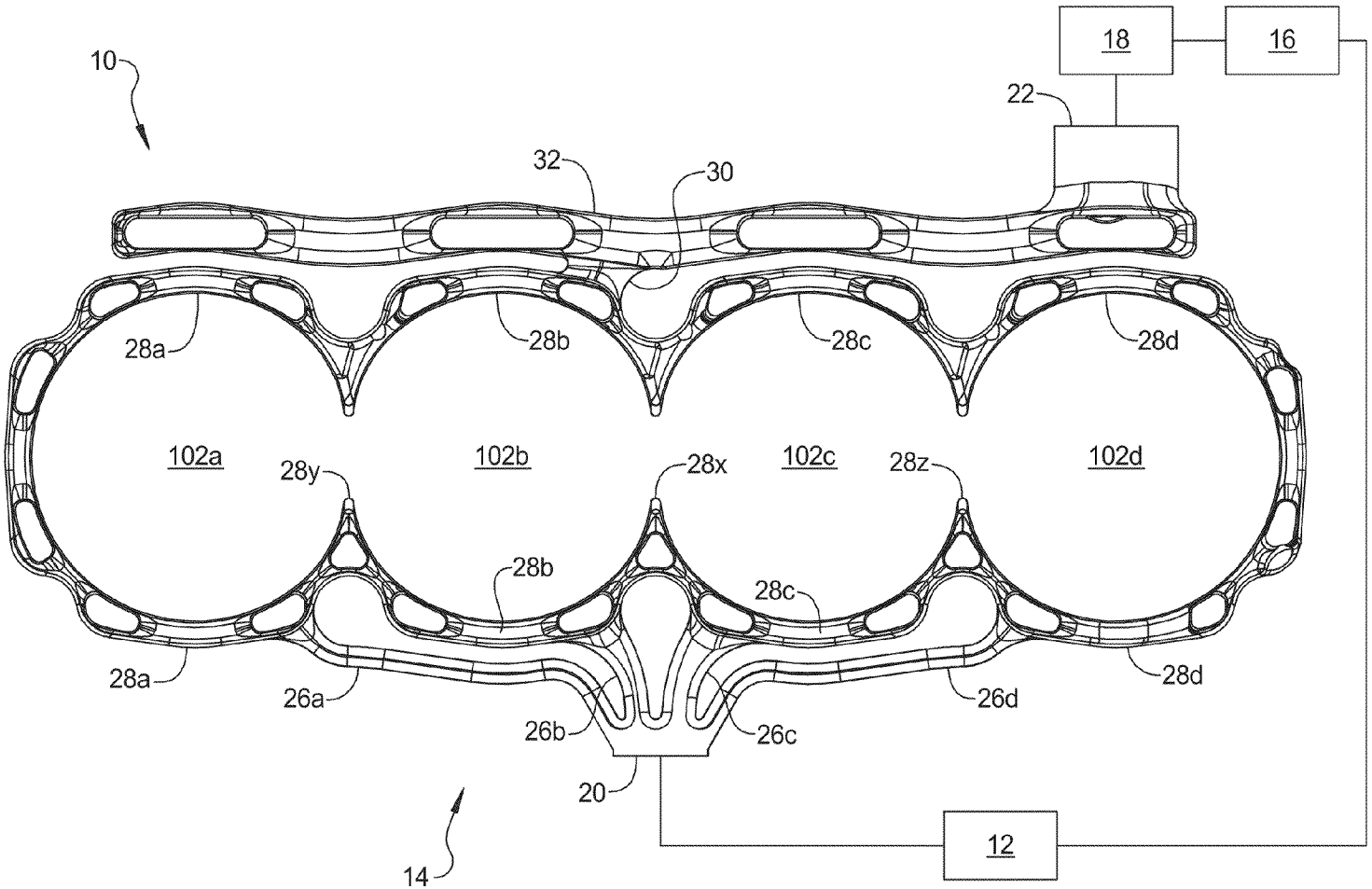
FIG. 2 is a schematic view of the fluidic passages of the cooling system of the present teachings.
Figure 3:
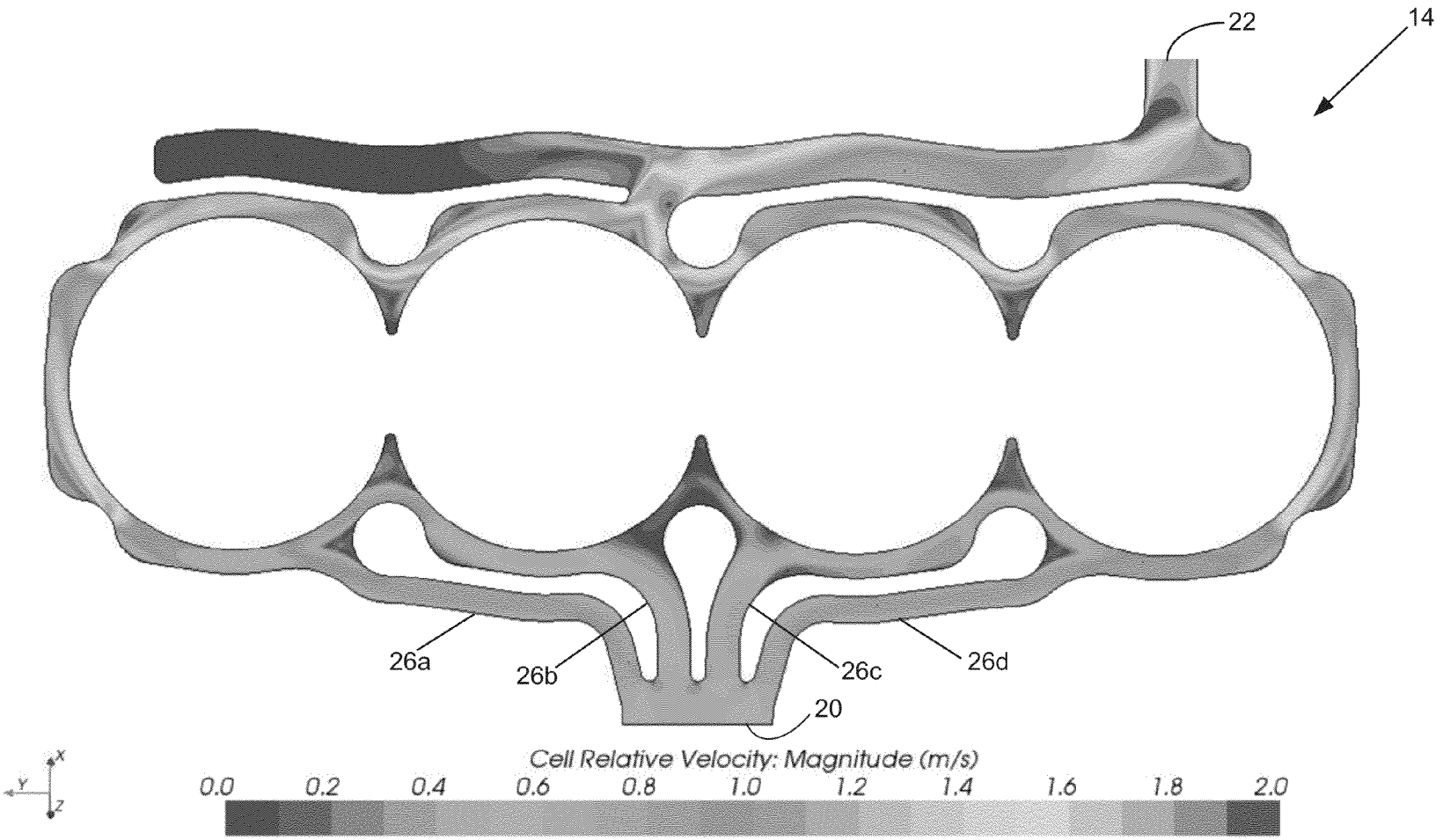
FIG. 3 is a model illustrating the relative flow velocity magnitude of the cooling system of the present teachings.

With continued reference to FIGS. 1 and 2, cylinder block cooling system 10 can be used in internal combustion engine 100. As described, internal combustion engine 100 can comprise a plurality of piston cylinders 102 being disposed in a generally linear or inline arrangement. For purposes of illustration, the plurality of piston cylinders 102 will be referred to as first cylinder 102*a*, second cylinder 102*b*, third cylinder 102*c*, and fourth cylinder 102*d*. It should be recognized that the principles of the present teachings are not limited to only four cylinder internal combustion engine applications. The principles of the present teachings are equally applicable to engines having any number of multiple cylinders, including, but not limited to, two, three, five, six, eight, ten, twelve, and the like.

The plurality of piston cylinders 102 is disposed in a cylinder block member 104. Cylinder block member 104 is made of any material conducive to the anticipated structural and other demands, such as aluminum, aluminum alloy, iron, multi-material combinations (e.g. sleeves), and other conventional materials.

Internal combustion engine 100 further comprises cylinder block cooling system 10 having a liquid coolant source 12, a cylinder cooling passage network 14, and a liquid coolant reservoir 16. It should be understood that in some embodiments the cooling system 10 can comprise a closed, continuous system wherein liquid coolant source 12 and liquid coolant reservoir 16 can be in fluid communication to permit the liquid coolant to flow therebetween. Moreover, cooling system 10 can include a conventional radiator 18 for dissipating heat (i.e. acting as a heat exchanger) from the liquid coolant to a surrounding medium (e.g. ambient air).

In some embodiments, cylinder cooling passage network 14 can comprise an inlet 20, an outlet 22, and a series of fluidic passages extending therebetween. Inlet 20 can be in fluid communication with liquid coolant source 12 to receive liquid coolant at a first temperature. Conversely, outlet 22 can be in fluid communication with radiator 18 and liquid coolant reservoir 16.

With particular reference to FIG. 2, cylinder cooling passage network 14 will be described in greater detail. In some embodiments, cylinder cooling passage network 14 is configured to define generally uniform cooling of each of the plurality of piston cylinders 102. To this end, cylinder cooling passage network 14 provides a plurality of individual fluidic passages extending in a predetermined configuration to provide each of the plurality of piston cylinders 102 a portion of liquid coolant directly from liquid coolant source 12. In this way, which will be described, each of the plurality of piston cylinders 102 is cooled with liquid coolant that has not experienced upstream heating as a result of exposure to adjacent cylinders and, thus, is capable of achieving a uniform temperature gradient across the cylinder block. Moreover, in some embodiments, such temperature gradient can provide lower bore distortion of the piston cylinders 102 and thereby reduce piston blow-by.

In some embodiments, cylinder cooling passage network 14 is tuned to provide a predetermined flow pattern, rate, and/or pressure for enhanced cooling response. For example, in some embodiments, cylinder cooling passage network 14 can comprise a first upstream fluidic passage 26*a* being directly routed from inlet 20 to an area adjacent first cylinder 102*a*, a second upstream fluidic passage 26*b* being directly routed from inlet 20 to an area adjacent second cylinder 102*b*, a third upstream fluidic passage 26*c* being directly routed from inlet 20 to an area adjacent third cylinder 102*c*, and a fourth upstream fluidic passage 26*d* being directly routed from inlet 20 to an area adjacent fourth cylinder 102*d*. In some embodiments, each of the upstream fluidic passages 26 can be configured, shaped, contoured, or otherwise tuned to address specific cooling requirements of engine 100. That is, depending upon the specific cooling needs of engine 100, such as related to the thermal mass of adjacent sections of the engine, ancillary air flow around the exterior of the engine, and/or other factors, each of the upstream fluidic passages 26 can comprise a unique configuration that results in a predetermined cooling profile of the corresponding cylinder and related structure. However, in some embodiments, each of the upstream fluidic passages 26 can comprise similar configurations that results in predetermined cooling profiles, such as configurations defining mirrored symmetry. For example, in the embodiment illustrated in the figures, first upstream fluidic passage 26*a* and fourth upstream fluidic passage 26*d* can define configurations having mirrored symmetry and cooling profiles. Similarly, second upstream fluidic passage 26*b* and third upstream fluidic passage 26*c* can define configurations having mirrored symmetry and cooling profiles. For purposes of this discussion, it should be understood that the aforementioned mirrored symmetries exist. However, it should also be understood that such symmetry is not required and thus each upstream passage can be varied individually or in combination. For example, as is specifically illustrated, in some embodiments, second upstream fluidic passage 26*b* and third upstream fluidic passage 26*c* can define different cross-sectional and/or routing profiles that can permit a tailor flow response and associated cooling profile. For instance, in some embodiments, third upstream fluidic passage 26*c* can be larger than second upstream fluidic passage 26*b*.

Figure 4:
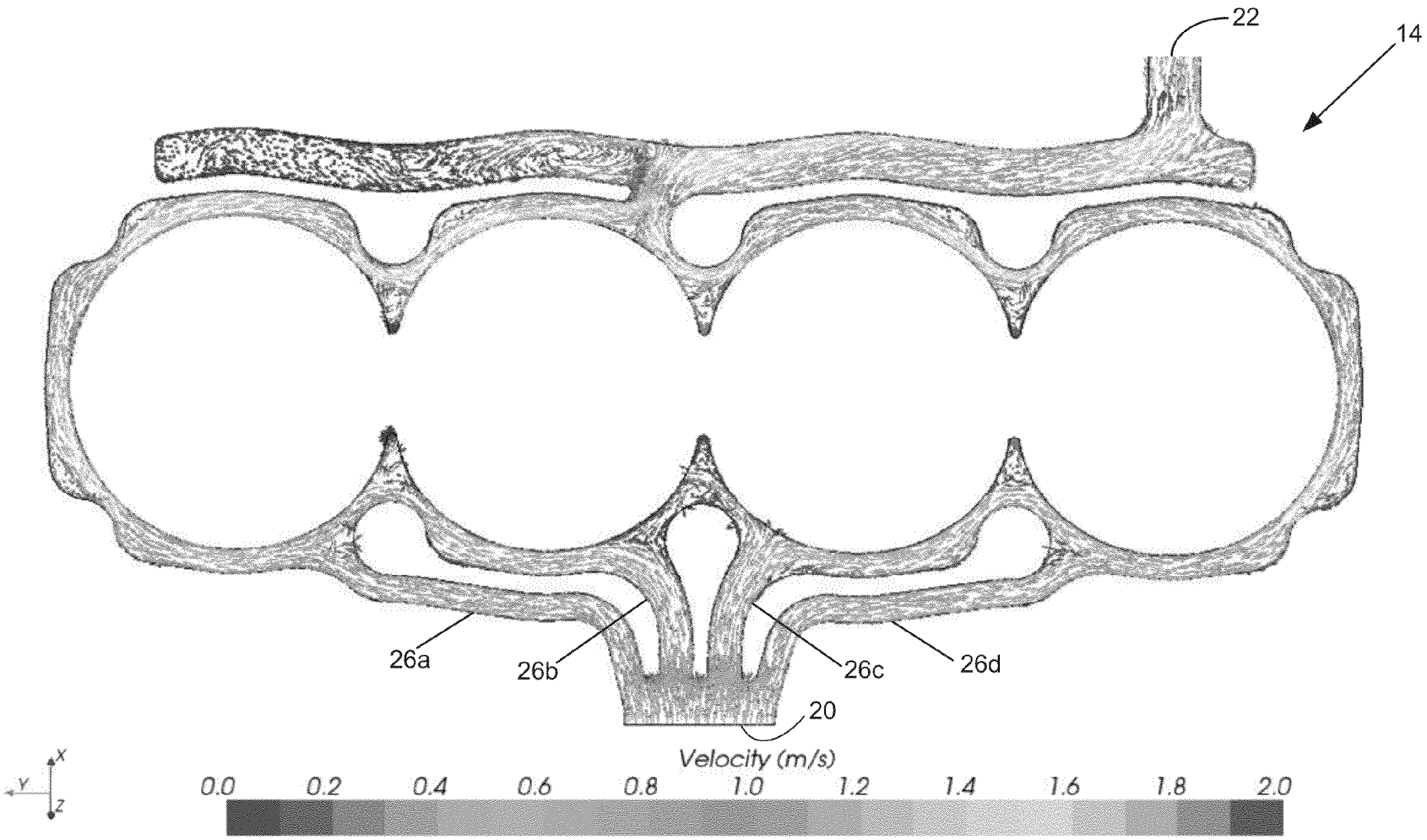
FIG. 4 is a model illustrating the flow velocity and directional vectors of the cooling system of the present teachings.
Figure 5:
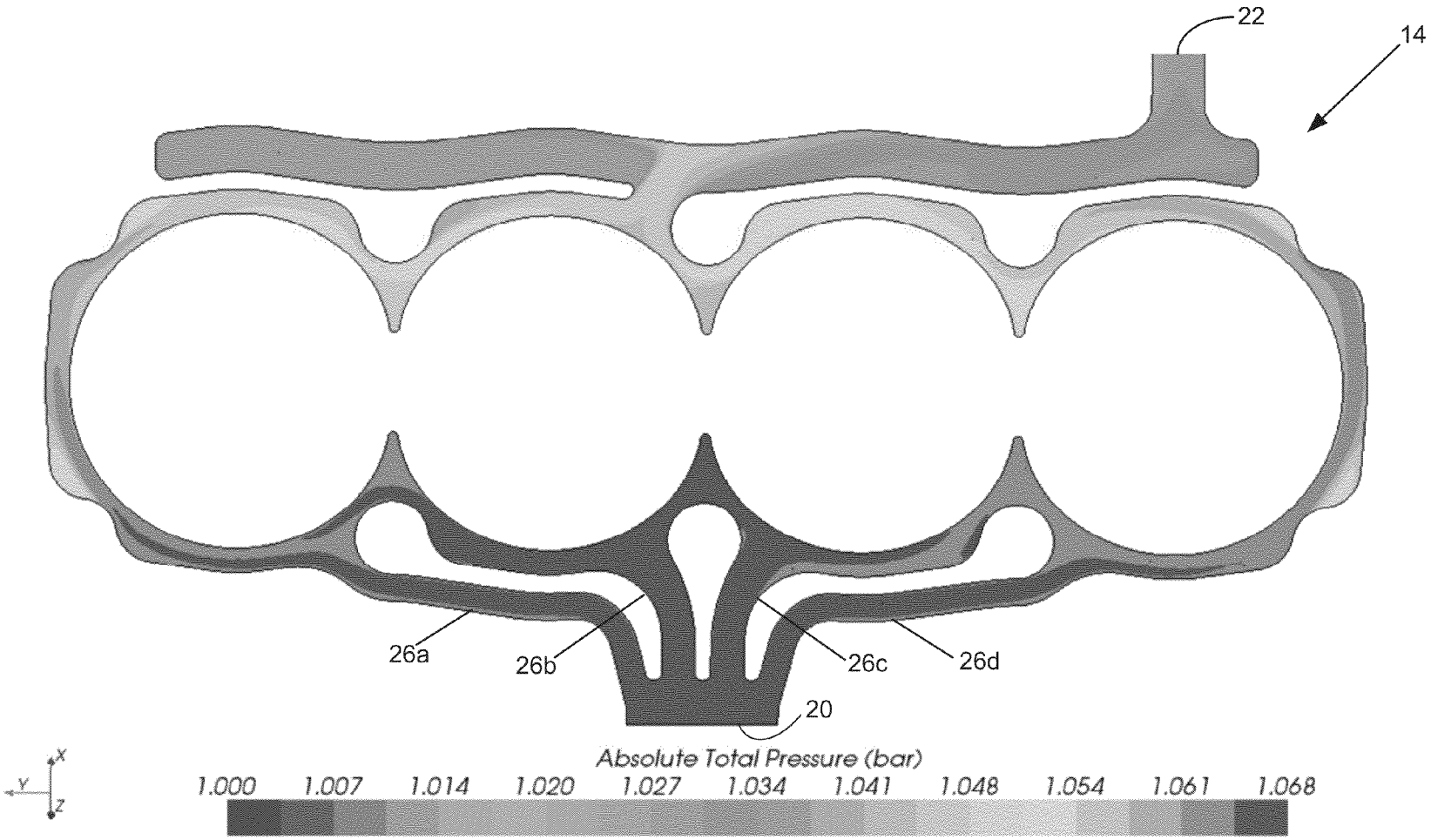
FIG. 5 is a model illustrating the absolute total pressure of the cooling system of the present teachings.
Figure 6A:
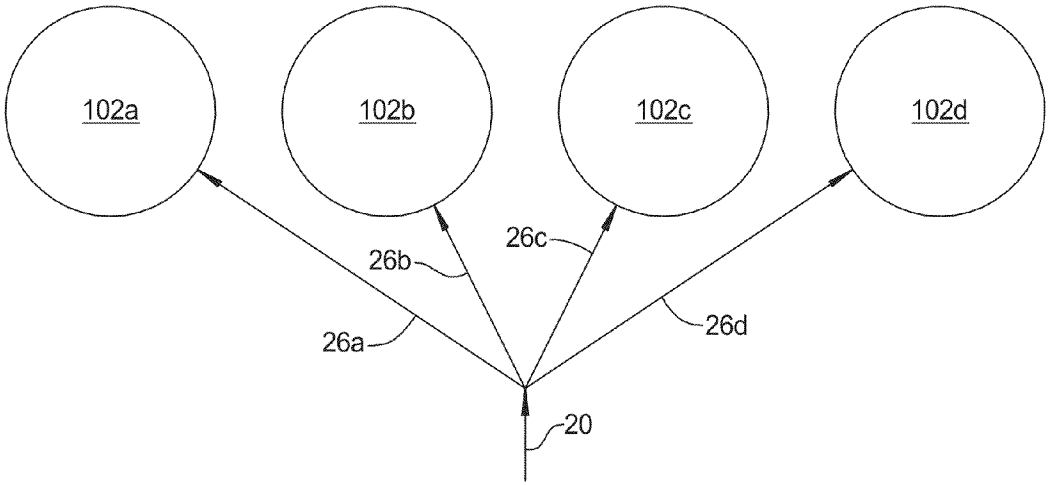
FIG. 6A is a schematic view of the fluidic passages of the cooling system originating from a single point location relative to each other.
Figure 6B:
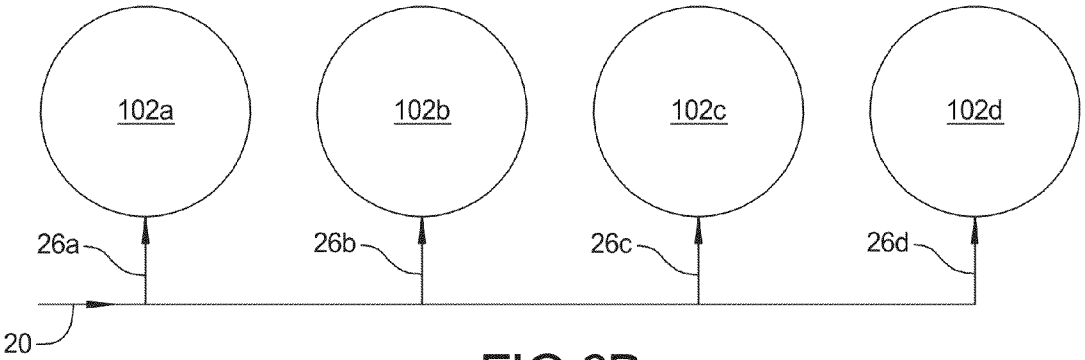
FIG. 6B is a schematic view of the fluid passages of the cooling system originating from multiple point locations relative to each other.

With particular reference to FIGS. 6A and 6B, in some embodiments, inlet 20 can comprise one or more orientations. For example, as illustrated in FIGS. 1-6A, inlet 20 can fluidly couple with each of the passages 26*a*, 26*b*, 26*c*, and 26*d* at a single point location 20'. This results in each passage 26*a*, 26*b*, 26*c*, and 26*d* being fluidly coupled to inlet 20 at a single downstream position relative to each other. Alternatively, as illustrated in FIG. 6B, inlet 20 can fluidly couple with each of the passages 26*a*, 26*b*, 26*c*, and 26*d* at multi-point locations 20". This multi-point location scenario can resemble a branch network wherein each passage 26*a*, 26*b*, 26*c*, and 26*d* is fluidly coupled to inlet 20 at discrete downstream positions relative to each other. It should also be understood that combinations of these configurations are envisioned, including a combination of both single point and multi-point scenarios in a single embodiment.

In some embodiments, cylinder cooling passage network 14 can further comprise a series of fluidic jacket passages 28 generally immediately adjacent each of the piston cylinders 102 and fluidly coupled to upstream fluidic passages 26. The fluidic jacket passages 28 are each in a position to absorb heat from the corresponding piston cylinder 102 and, thus, are generally recognized by their position immediate to the corresponding piston cylinder 102. Specifically, cylinder cooling passage network 14 can comprise a first jacket passage 28*a* being directly routed from first upstream fluidic passage 26*a* to an area immediately adjacent first cylinder 102*a*, a second jacket passage 28*b* being directly routed from second upstream fluidic passage 26*b* to an area immediately adjacent second cylinder 102*b*, a third jacket passage 28*c* being directly routed from third upstream fluidic passage 26*c* to an area immediately adjacent third cylinder 102*c*, and a fourth jacket passage 28*d* being directly routed from fourth upstream fluidic passage 26*d* to an area immediately adjacent fourth cylinder 102*d*.

In some embodiments, second jacket passage 28*b* and third jacket passage 28C can be fluidly coupled at or along an interconnecting passage 28*x* extending therebetween. This interconnecting passage 28*x* can be that portion where second jacket passage 28*b* and third jacket passage 28*c* merge together and, thus, does not need to include a separate passage per se. Similarly, first jacket passage 28*a* and second jacket passage 28*b* can be fluidly coupled at or along an interconnecting passage 28*y* extending therebetween and third jacket passage 28*c* and fourth jacket passage 28*d* can be fluidly coupled at or along an interconnecting passage 28*z* extending therebetween. In this way, upstream fluidic passages 26 and portions of jacket passages 28 can define a parallel-flow fluidic network having parallel flow of liquid coolant being routed directly to each of the piston cylinders 102. This flow can then mix together to flow around the outboard sides of the piston cylinders 102 to an opposing, downstream side of the piston cylinders 102—specifically, this flow can be transmitted along the outboard side of first jacket passage 28*a* to a position on the downstream side of first piston cylinder 102*a* and additional flow can be transmitted along the outboard side of fourth jacket passage 28*d* to a position on the downstream side of fourth piston cylinder 102*d*.

It should be appreciated that based on flow design parameters and associated temperature gradients, in some embodiments, the cross-sectional design and shape of upstream fluidic passages 26 can be tailored to tune the parallel flow of liquid coolant to particular piston cylinders, such as to those cylinders whose liquid coolant will flow to adjacent cylinders. As seen in FIGS. 2-5, second upstream fluidic passage 26*b* can be sized larger and/or straighter relative to first upstream fluidic passage 26*a* to encourage additional flow of liquid coolant therethrough for improved thermal performance. Similarly, the routing shape of first upstream fluidic passage 26 can be varied to encourage or discourage flow therethrough, such as by using sharp curves (see first upstream fluidic passage 26*a*) or gentle curves (see second upstream fluidic passage 26*b*).

During the course of flow to the downstream side of the piston cylinders, the liquid coolant flow continued to absorb and retain heat from the associated piston cylinders. The liquid coolant can flow along both first jacket passage 28*a* and fourth jacket passage 28*d* and continue along the downstream side of the piston cylinders. To this end, liquid coolant from first jacket passage 28*a* can pass to the downstream side of second jacket passage 28*b*. Likewise, liquid coolant from fourth jacket passage 28*d* can pass to the downstream side of third jacket passage 28*c*.

The liquid coolant can then pass from the downstream side of jacket passages 28 at one or more exit passages 30 into an exit manifold 32 to outlet 22. It should be recognized that any one of a number of exit passages 30 can be used dependent upon the desired flow rate and route of the liquid coolant.

It should be appreciated that the principles of the present teachings provide a cooling system that is capable of provide consistent cooling of the cylinders of an engine. Moreover, the principles of the present teachings provide a cooling system capable of individually cooling each of the plurality of cylinders in the engines to a generally uniform temperature. This can be seen in the modeled flow performance illustrates of FIGS. 3-5. Specifically, with reference to FIG. 3, it can be seen that the cooling system of the present teachings provides a generally balanced flow magnitude, as evident by the generally uniform color profile of FIG. 3. Similarly, as illustrated in FIGS. 4 and 5, respectively, the cooling system of the present teachings provides generally uniform flow velocity and a generally balanced upstream fluid pressure and consistent downstream fluid pressure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cooling system for an engine, the engine having a plurality of piston cylinders, the cooling system comprising:

a liquid coolant source having liquid coolant; and a cylinder cooling passage network having an inlet and an outlet, the inlet being fluidly coupled to the liquid coolant source to receive the liquid coolant, the cylinder cooling passage network receiving and transmitting the liquid coolant therethrough, the cylinder cooling passage network further having:

a plurality of individual upstream fluidic passages each being fluidly coupled to the inlet to directly receive the liquid coolant from the liquid coolant source, each of the plurality of individual upstream fluidic passages being configured to establish parallel flow of the liquid coolant relative to the other of the plurality of individual upstream fluidic passages; and a plurality of cylinder jacket passages each extending about a portion of a corresponding one of the plurality of piston cylinders and being positioned immediately adjacent thereto, each of the plurality of cylinder jacket passages being fluidly coupled directly to a corresponding one of the plurality of individual upstream fluidic passages to receive the liquid coolant and transmit the liquid coolant to the outlet, wherein a first of the plurality of individual upstream fluidic passages defines a cross-sectional profile that is different than a second of the plurality of individual upstream fluidic passages.

2. The cooling system according to claim 1 wherein each of the plurality of individual upstream fluidic passages is individually tuned to provide a generally uniform temperature gradient across each of the plurality of piston cylinders of the engine.

3. The cooling system according to claim 1 wherein each of the plurality of individual upstream fluidic passages defines a liquid coolant flow rate that is different than at least one other of the plurality of individual upstream fluidic passages.

4. The cooling system according to claim 1 wherein one of the plurality of individual upstream fluidic passages defines a liquid coolant flow path shape that inhibits flow of the liquid coolant relative to at least one other of the plurality of individual upstream fluidic passages.

5. The cooling system according to claim 1 wherein a first of the plurality of cylinder jacket passages is fluidly coupled to a first of the plurality of upstream fluidic passages, a second of the plurality of cylinder jacket passages is fluidly coupled to a second of the plurality of upstream fluidic passages, the second cylinder jacket passage being fluidly coupled to the first cylinder jacket passage such that the liquid coolant within the second cylinder jacket passage mixes with the liquid coolant within the first cylinder jacket passage.

6. The cooling system according to claim 5 wherein a liquid coolant flow rate of the second upstream fluidic passage is greater than a liquid coolant flow rate of the first upstream fluidic passage.

7. The cooling system according to claim 1 wherein a first of the plurality of cylinder jacket passages is fluidly coupled to a first of the plurality of upstream fluidic passages, a second of the plurality of cylinder jacket passages is fluidly coupled to a second of the plurality of upstream fluidic passages, a third of the plurality of cylinder jacket passages is fluidly coupled to a third of the plurality of upstream fluidic passages, a fourth of the plurality of cylinder jacket passages is fluidly coupled to a fourth of the plurality of upstream fluidic passages, the first, second, third, and fourth cylinder jacket passages each being fluidly coupled to each other.

8. The cooling system according to claim 7 wherein a liquid coolant flow rate of the second and third upstream fluidic passages is greater than a liquid coolant flow rate of the first and fourth upstream fluidic passages.

9. An engine comprising:

a plurality of piston cylinders, each of the plurality of piston cylinders having a piston slidably disposed therein;

a cooling system comprising:

a liquid coolant source having liquid coolant; and a cylinder cooling passage network having an inlet and an outlet, the inlet being fluidly coupled to the liquid coolant source to receive the liquid coolant, the cylinder cooling passage network receiving and transmitting the liquid coolant therethrough, the cylinder cooling passage network further having:

a plurality of individual upstream fluidic passages each being fluidly coupled to the inlet to directly receive the liquid coolant from the liquid coolant source, each of the plurality of individual upstream fluidic passages being configured to establish parallel flow of the liquid coolant relative to the other of the plurality of individual upstream fluidic passages; and a plurality of cylinder jacket passages each extending about a portion of a corresponding one of the plurality of piston cylinders and being positioned immediately adjacent thereto, each of the plurality of cylinder jacket passages being fluidly coupled directly to a corresponding one of the plurality of individual upstream fluidic passages to receive the liquid coolant and transmit the liquid coolant to the outlet, wherein each of the plurality of individual upstream fluidic passages defines a liquid coolant flow rate that is different than at least one other of the plurality of individual upstream fluidic passages.

10. The cooling system according to claim 9 wherein a first of the plurality of individual upstream fluidic passages defines a cross-sectional profile that is different than a second of the plurality of individual upstream fluidic passages.

11. The cooling system according to claim 9 wherein each of the plurality of individual upstream fluidic passages is individually tuned to provide a generally uniform temperature gradient across each of the plurality of piston cylinders of the engine.

12. The cooling system according to claim 9 wherein one of the plurality of individual upstream fluidic passages defines a liquid coolant flow path shape that inhibits flow of the liquid coolant relative to at least one other of the plurality of individual upstream fluidic passages.

13. The cooling system according to claim 9 wherein a first of the plurality of cylinder jacket passages is fluidly coupled to a first of the plurality of upstream fluidic passages, a second of the plurality of cylinder jacket passages is fluidly coupled to a second of the plurality of upstream fluidic passages, the second cylinder jacket passage being fluidly coupled to the first cylinder jacket passage such that the liquid coolant within the second cylinder jacket passage mixes with the liquid coolant within the first cylinder jacket passage.

14. The cooling system according to claim 13 wherein a liquid coolant flow rate of the second upstream fluidic passage is greater than a liquid coolant flow rate of the first upstream fluidic passage.

15. The cooling system according to claim 9 wherein a first of the plurality of cylinder jacket passages is fluidly coupled to a first of the plurality of upstream fluidic passages, a second of the plurality of cylinder jacket passages is fluidly coupled to a second of the plurality of upstream fluidic passages, a third of the plurality of cylinder jacket passages is fluidly coupled to a third of the plurality of upstream fluidic passages, a fourth of the plurality of cylinder jacket passages is fluidly coupled to a fourth of the plurality of upstream fluidic passages, the first, second, third, and fourth cylinder jacket passages each being fluidly coupled to each other.

16. The cooling system according to claim 15 wherein a liquid coolant flow rate of the second and third upstream fluidic passages is greater than a liquid coolant flow rate of the first and fourth upstream fluidic passages.

17. A cooling system for an engine, the engine having a plurality of piston cylinders, the cooling system comprising:

a liquid coolant source having liquid coolant; and a cylinder cooling passage network having an inlet and an outlet, the inlet being fluidly coupled to the liquid coolant source to receive the liquid coolant, the cylinder cooling passage network receiving and transmitting the liquid coolant therethrough, the cylinder cooling passage network further having:

a plurality of individual upstream fluidic passages each being fluidly coupled to the inlet to directly receive the liquid coolant from the liquid coolant source, each of the plurality of individual upstream fluidic passages being configured to establish parallel flow of the liquid coolant relative to the other of the plurality of individual upstream fluidic passages;

a plurality of cylinder jacket passages each extending about a portion of a corresponding one of the plurality of piston cylinders and being positioned immediately adjacent thereto, each of the plurality of cylinder jacket passages being fluidly coupled directly to a corresponding one of the plurality of individual upstream fluidic passages to receive the liquid coolant and transmit the liquid coolant to the outlet, wherein the cylinder cooling passage network is configured to define a generally uniform temperature gradient among the plurality of piston cylinders of the engine through localized tuning of the flow of the liquid coolant, wherein one of the plurality of individual upstream fluidic passages defines a liquid coolant flow path shape that inhibits flow of the liquid coolant relative to at least one other of the plurality of individual upstream fluidic passages.

* * * * *